US007572096B2

(12) United States Patent
Nonaka et al.

(10) Patent No.: US 7,572,096 B2
(45) Date of Patent: Aug. 11, 2009

(54) VACUUM PUMP

(75) Inventors: Manabu Nonaka, Yachiyo (JP); Akihiko Wada, Yachiyo (JP)

(73) Assignee: BOC Edwards Japan Limited (JP)

( * ) Notice: Subject to any disclaimer, the term of this patent is extended or adjusted under 35 U.S.C. 154(b) by 634 days.

(21) Appl. No.: 11/092,898

(22) Filed: Mar. 29, 2005

(65) Prior Publication Data

US 2005/0249618 A1 Nov. 10, 2005

(30) Foreign Application Priority Data

May 10, 2004 (JP) ..... 2004-139331

(51) Int. Cl.
*F03B 11/02* (2006.01)

(52) U.S. Cl. ..... 415/90; 415/200

(58) Field of Classification Search ..... 415/200
See application file for complete search history.

(56) References Cited

U.S. PATENT DOCUMENTS

| | | | | |
|---|---|---|---|---|
| 4,404,263 | A * | 9/1983 | Hodes et al. | 428/564 |
| 4,904,542 | A * | 2/1990 | Mroczkowski | 428/610 |
| 5,871,820 | A * | 2/1999 | Hasz et al. | 427/419.2 |
| 5,891,267 | A * | 4/1999 | Schaeffer et al. | 148/206 |
| 6,368,672 | B1 * | 4/2002 | Thompson et al. | 427/452 |
| 6,582,779 | B2 * | 6/2003 | Li et al. | 427/585 |
| 2003/0021672 | A1 * | 1/2003 | Maejima et al. | 415/90 |
| 2003/0095860 | A1 * | 5/2003 | Takamine et al. | 415/90 |

FOREIGN PATENT DOCUMENTS

| | | | |
|---|---|---|---|
| EP | 1 273 802 | A | 1/2003 |
| EP | 1 314 891 | A1 | 5/2003 |
| EP | 1 340 918 | A | 9/2003 |
| JP | 09 303289 | A | 11/1997 |
| JP | 11257276 | | 9/1999 |
| JP | 2000 161286 | A | 6/2000 |
| JP | 01193686 | | 7/2001 |

OTHER PUBLICATIONS http://web.archive.org/web/20031211134926/http://snap.fnal.gov/crshield/crs-mech/emissivity-eoi.html.*
http://web.archive.org/web/20010124102400/http://www.omega.com/literature/transactions/volume1/emissivitya.html.*
http://web.archive.org/web/20040125054311/http://ib.cnea.gov.ar/~experim2/Cosas/omega/emissivity.htm.*

* cited by examiner

*Primary Examiner*—Edward Look
*Assistant Examiner*—Aaron R Eastman
(74) *Attorney, Agent, or Firm*—Adams & Wilks

(57) ABSTRACT

A vacuum pump is provided in which gas molecules in a vacuum chamber are sucked and exhausted by the rotational motion of a rotor rotatably supported in a pump case. At least one nickel alloy layer is disposed on a surface of at least one component defining a flow path in the vacuum pump for increasing a resistance of the component to corrosion due to a corrosive effect of a gas flowing through the flowpath. A nickel oxide is formed on a surface of the nickel alloy layer and has a higher emissivity than that of the nickel alloy layer for increasing a quantity of heat radiated from the surface of the component when the component is heated during operation of the vacuum pump.

9 Claims, 5 Drawing Sheets

VACUUM PUMP

BACKGROUND OF THE INVENTION

1. Field of the Invention

The present invention relates to a vacuum pump used for a semiconductor manufacturing apparatus. More particularly, the present invention relates to a surface treatment technique for improving the corrosion resistance and heat releasing property of a vacuum pump.

2. Description of the Related Art

Conventionally, the semiconductor manufacturing apparatus has used a vacuum pump to reduce the pressure in a vacuum chamber and to thereby obtain a predetermined degree of vacuum. As the vacuum pump of this type, a kinetic turbo-molecular pump is known. In the turbo-molecular pump, a rotor shaft integral with a rotor is rotatably supported in a pump case, a plurality of stages of rotor blades are provided on the outer wall surface of the rotor, and a plurality of stages of stator blades positioned between the rotor blades are provided on the inner wall surface of the pump case. When the rotor is rotated at a high speed after the pressure in the vacuum chamber has been made a predetermined value, an evacuating operation in which the rotating rotor blades and the fixed stator blades impart momentum to gas molecules colliding with the blades to transfer the gas molecules is performed. By this evacuating operation, the gas molecules sucked from the vacuum chamber into the pump case are exhausted while being compressed, by which the pressure in the vacuum chamber is reduced.

In the dry etching or CVD (chemical vapor deposition) process in the semiconductor manufacturing apparatus, when etching or cleaning utilizing a plasma reaction is performed, a chlorine-based or fluorine-based process gas having high reactivity is introduced into the vacuum chamber. Because this process gas generally has very high metal erodibility, the turbo-molecular pump that sucks the process gas and performs evacuation is required to have high corrosion resistance of various types of components incorporated in the pump case. Of these components, a component rotating at a high speed, such as the rotor, is usually formed of a light alloy such as an aluminum alloy from the viewpoints of high specific strength and reduced weight, but the corrosion resistance of aluminum alloy is insufficient especially to chlorine-based gas. Conventionally, therefore, plating of the aluminum alloy with a metal having high corrosion resistance, such as a nickel alloy, has widely been performed.

On the other hand, in the turbo-molecular pump of this type, the sucked gas molecules collide with the rotor blades and the stator blades and are compressed, and by frictional heat at the time of collision and compression heat at the time of compression, a rotating body consisting of the rotor and the rotor blades is heated to a high temperature. Also, the rated rotational speed of the rotating body is generally as high as 20,000 to 50,000 rpm, so that the rotating body is subjected to a great tensile stress due to a centrifugal force. Therefore, if the operation is continued for a long period of time, the rotating body in a state of being heated and subjected to tensile stress is plastically deformed gradually, causing creep deformation, and hence comes into contact with a fixed-side component facing to the rotating body with a minute gap provided therebetween. Thus, a crack is created at a part of the rotating body by this contact, and stress concentrates there, which may result in a breakage of the rotating body.

The principal reason why the rotating body is broken in the turbo-molecular pump is thought to be the overheating of the rotating body at the time of high-speed operation. Therefore, in order to prevent the breakage of rotating body, it is necessary to efficiently release heat accumulated in the rotating body to perform cooling. The method for cooling is broadly divided into conduction heat release and radiation heat release. As an example of the former conduction heat release, a method in which heat conduction is performed through a bearing and a method in which heat conduction is performed through a gas are known. Also, as an example of the latter radiation heat release, a method in which the heat of rotor is radiated to a component on the fixed side is known.

However, in the case of the former conduction heat release utilizing a bearing, for example, if the rotor is supported by a magnetic levitation bearing, since the rotor shaft and the bearing are not in contact with each other, it is impossible to directly conduct the heat of rotor from the rotor shaft to the bearing. Also, in the case of the conduction heat release utilizing a gas, when a gas having low heat conductivity of gas molecule, such as argon, krypton, xenon, and other rare gases, is exhausted, heat conduction through the gas is scarcely anticipated. It can be thought that heat conduction is performed by filling the pump case with a purge gas with high heat conductivity, such as hydrogen or helium. In this case, since a large amount of gas flows in the pump case, the pressure in the pump case or the vacuum chamber fluctuates greatly, so that the quantity of heat capable of being released is restricted.

Thereupon, the rotating body is cooled by the latter radiation heat release. At this time, if the rotor is subjected to nickel alloy plating as described above, the quantity of heat radiated from the surface of rotor is decreased, and therefore the heat releasing property is decreased remarkably. The reason for this is that the emissivity of nickel is about 0.1 to 0.2 while the emissivity of aluminum as material of the rotor is about 0.3, so that the emissivity of the rotor as a whole is decreased by nickel alloy plating.

The emissivity is defined as the ratio of the luminance of heat radiation on an object to the luminance of heat radiation on a black body having the same temperature, in other words, the ratio of the quantity of radiated heat on an object to that on a black body having the largest quantity of radiated heat, which is represented with the black body being 1. As an object comes closer to black color, the emissivity increases, and the quantity of heat radiated from the surface thereof increases. That is to say, if the rotor made of an aluminum alloy is subjected to nickel alloy plating to improve corrosion resistance to corrosive gas, the quantity of heat radiated from the rotor surface decreases, and hence radiation transmission to the fixed side becomes difficult to perform, which results in a disadvantage that the rotating body cannot be cooled efficiently.

Japanese Patent Laid-Open No. 11-257276 has disclosed a technique for applying a metal plating layer containing ceramic particles onto the surface of the rotor made of an aluminum alloy. According to this technique, it is thought that the quantity of heat radiated from the surface thereof increases because the emissivity of ceramic particles is about 0.7 to 0.8. However, the ceramic particles are dispersed in the nickel alloy, and the quantity of heat radiated from the nickel alloy occupying most of the surface area is still small. Therefore, the emissivity of the whole of the surface of metal plating layer is not so high, and it cannot be said that the heat releasing property of rotor is sufficient. To solve this problem, it can be thought that the content of ceramic particles is increased. In this case, however, the bonding strength of nickel alloy that joins ceramic particles becomes low, so that the ceramic particles may undesirably be peeled off from the metal plating layer by a centrifugal force during high-speed rotation.

Japanese Patent Laid-Open No. 2001-193686 has disclosed a technique for improving the emissivity of a component surface by providing a coating layer in which particulates of ceramic or resin etc. are added to a black nickel alloy or a black chromium alloy on the surface of a component in the vacuum pump. Also, it is common practice to form a ceramic layer on the surface of a component by thermal spraying or to form a layer on the surface of a component by the coating, bonding, etc. of a mixture of ceramics with a binding agent such as a polymer. With such methods, however, the polymer used as an additive or a binding agent has corrosion resistance lower than that of the nickel alloy layer, which presents a problem in that corrosion proceeds from that portion, and attacks the base material. Also, since only a porous layer is obtained by thermal spraying, there arises a possible problem in that the corrosive gas intrudes into the base material through the pores to corrode the base material.

SUMMARY OF THE INVENTION

The present invention has been made in view of the above circumstances, and accordingly an object thereof is to provide a vacuum pump in which the corrosion resistance to a corrosive gas and the heat releasing property of a heated component are enhanced.

To achieve the above object, the present invention provides a vacuum pump in which gas molecules in a vacuum chamber are sucked and exhausted by the rotational motion of a rotor rotatably supported in a pump case, wherein a nickel alloy layer is provided at least on the surface of a component defining a flow passage in the pump, and a nickel oxide is formed on the surface of the nickel alloy layer.

As a method for forming the nickel alloy layer, known nonelectrolytic plating or electroplating may be used. However, in order to form a layer with a uniform thickness on the surface of a base material having an intricate shape, nonelectrolytic plating is preferably used. The nickel alloy layer may be an alloy of nickel and a different kind of metal. As examples of the alloy, a nickel-phosphorus alloy and a nickel-boron alloy can be cited. Also, the thickness of the nickel alloy layer should be at least 10 μm, which is a target value considering tolerance variations. If the thickness is increased, the probability of pinholes arriving at the surface of the base material decreases, and thereby the intrusion of corrosive gas can be inhibited surely, but the mass of rotating body is increased by the increase in thickness. Therefore, the thickness of the nickel alloy layer should preferably be about 20 μm. It is preferable that the base material of a component is formed of a metallic material having a high specific strength. In particular, considering the viewpoints of heat conductivity, workability, and lightweight, an aluminum alloy or a magnesium alloy is preferably used.

As a method for forming the nickel oxide, after the aforementioned plating has been performed on the surface of a component, an oxidizing agent is caused to react on the surface to forcedly oxidize nickel on the surface of the nickel alloy layer. Specifically, since nickel is a metal less liable to be oxidized, it is necessary to accelerate oxidizing reaction by using the oxidizing agent to accomplish oxidation to a degree such that the heat radiation property is achieved effectively. For example, a component subjected to nonelectrolytic nickel plating has only to be immersed in solution of chemicals such as nitric acid, oxalic acid, or sulfuric acid. Thereby, the erosion reaction due to the oxidizing agent is forcedly caused to proceed on the boundary surface between the nickel alloy layer and the solution of chemicals, and some of nickel crystals forming the nickel alloy layer are oxidized. As the result, a nickel oxide having a color close to black is deposited.

If the nickel alloy layer is provided on the base material as described above, the base material can be protected from being eroded by the corrosive gas. In addition, since the emissivity of the nickel oxide formed on the surface of the nickel alloy layer is higher than that of the nickel alloy layer, the quantity of heat radiated from the outermost surface of the component increases, and the heat releasing efficiency of the heated component is improved significantly. Incidentally, the measurement results revealed that the emissivity of the nonelectrolytic nickel plating allowed to stand naturally was about 0.1 to 0.2, while the emissivity of the surface of the nickel oxide allowed to react by the oxidizing agent increased to about 0.6 to 0.7. Also, the observation of the surface condition at this time revealed that of the nickel showing on the surface, about 80% or more was in an oxidized state. Therefore, according to this surface treatment technique, it can be anticipated that the quantity of heat radiated from the surface of component increases by a factor of at least three to five times.

Also, the nickel oxide is formed only on a very thin surface layer of the nickel alloy layer, and is incorporated in a nickel metal crystal forming the nickel alloy layer. Therefore, practically as well, the adhesion strength does not become insufficient, and the nickel oxide sufficiently withstands the centrifugal force of the rotor rotating at a high speed during the operation of the vacuum pump, and does not scatter. In addition, the formed nickel oxide itself does not contain an additive such as sulfur, so that there is no fear of impairing the corrosion resistance to corrosive gas.

In this surface treatment technique, because oxidation is accomplished forcedly by the oxidizing agent, the lower nickel alloy layer is eroded in no small quantities. In particular, it is sufficiently conceivable that the forced oxidation reaches the base material through pin holes generated with a certain probability when the nickel alloy layer is formed, by which the base material is eroded. As the measures against this phenomenon, it is effective that the nickel alloy layer on the base material is formed in two or more layers. In order to form the nickel alloy layer in two or more layers, layer formation has only to be performed, for example, by dividing the process of nonelectrolytic nickel plating into a plurality of cycles. Thereby, even if a pin hole is generated, the pinhole is cut at the boundary between the layers, so that the probability of occurrence of the pinhole penetrating from the outermost layer to the base material can be decreased. Therefore, a danger that the base material is eroded in the forced oxidation process can be made very little.

Furthermore, it can be said that the heat transmission by radiation is more advantageous as the surface area of the radiation surface increases. Thereupon, since the increase in surface area leads to an increase in quantity of heat radiated from the component surface, it is preferable to increase the surface area by increasing the irregularities on the surface of the nickel alloy layer. For example, if plating treatment is performed by mixing nickel metal particles in a nickel plating solution, the nickel metal particles show on the surface layer, and irregularities can be formed on the surface. If the surface of the nickel alloy layer having the irregularities is oxidized, the surface area of the formed nickel oxide is also increased. The nickel metal particles existing in the nickel alloy layer are bonded firmly and integrated with the nickel alloy layer, so that no influence is exerted on the corrosion resistance of that layer. By a synergetic effect of improved emissivity and increased surface area, the surface treatment layer ideal for heat radiation of component can be obtained.

If the diameter of particle is at least not smaller than one half of the thickness of plating, an advantageous effect can be achieved. Especially if the diameter thereof is not smaller than the thickness of plating, the effect is increased. Also, in the case where the plating thickness is large, after a nickel plating layer with a predetermined thickness has been formed, plating may be performed by mixing particles such as to have a high ratio of the particle diameter to the plating thickness.

This surface treatment technique is applied to all of the components incorporated in a vacuum pump for sucking and exhausting corrosive gas. In particular, this technique is preferably applied to the components that face to the flow passage of corrosive gas sucked in the pump case. Of these components, especially the rotor rotatably supported in the pump case is not only exposed to corrosive gas but also heated by the frictional heat and compression heat of gas during the high-speed rotation, so that the rotor is a component requiring both high corrosion resistance and heat releasing property. Therefore, the application of this surface treatment technique to the rotor is valuable. In particular, in the case of the vacuum pump in which a plurality of stages of rotor blades are provided on the outer wall surface of the rotor body as the shape of rotor, and a plurality of stages of stator blades are provided so as to be positioned and fixed alternately between the rotor blades, the frictional heat and compression heat are liable to accumulate in a narrow gap between the rotor blade and the stator blade, so that the possibility of overheated rotor is high, and hence efficient heat release is required. According to the vacuum pump incorporating this rotor, the fracture of rotor by erosion caused by corrosive gas is restrained, and moreover the quantity of heat radiated from the heated rotor increases and the heat is transmitted efficiently to the fixed side.

The above-described operation and effects are effectively achieved in the case where in the vacuum pump, a structure for rotatably supporting the rotor is a magnetic levitation type bearing structure. The reason for this is that according to the magnetic levitation type bearing structure, a rotor shaft integral with the rotor is not in contact with the bearing, and hence the heat of the rotor cannot be conducted directly from the rotor shaft to the bearing, so that the heat release of rotor relies greatly on the radiation to various types of components on the fixed side that face to the rotor.

The above-described surface treatment technique can be applied to various components on the fixed side in the same way. However, considering that, unlike the rotor, the component on the fixed side especially has little danger of erosion, ceramics coating treatment may be performed on the surface of the component as hole sealing treatment, or if the base material is made of aluminum, only alumite coating treatment may be performed.

According to the present invention, since the surface treatment layer consisting of the nickel alloy layer and the nickel oxide is provided on the surface of the component incorporated in the vacuum pump, both characteristics of corrosion resistance and heat releasing property can be improved. Therefore, the present invention achieves an effect that the reliability is high in exhausting a highly corrosive gas such as a chlorine-based or fluorine-based process gas or a gas having low heat conductivity of gas molecules such as argon, krypton, xenon, and other rare gases, and a rotating body is prevented from being erosion fractured due to corrosive gas or creep fractured due to overheating, so that high-performance evacuation can be accomplished.

DETAILED DESCRIPTION OF THE PREFERRED EMBODIMENTS

A preferred embodiment for carrying out the present invention will now be described in detail with reference to the accompanying drawings.

Figure 1:
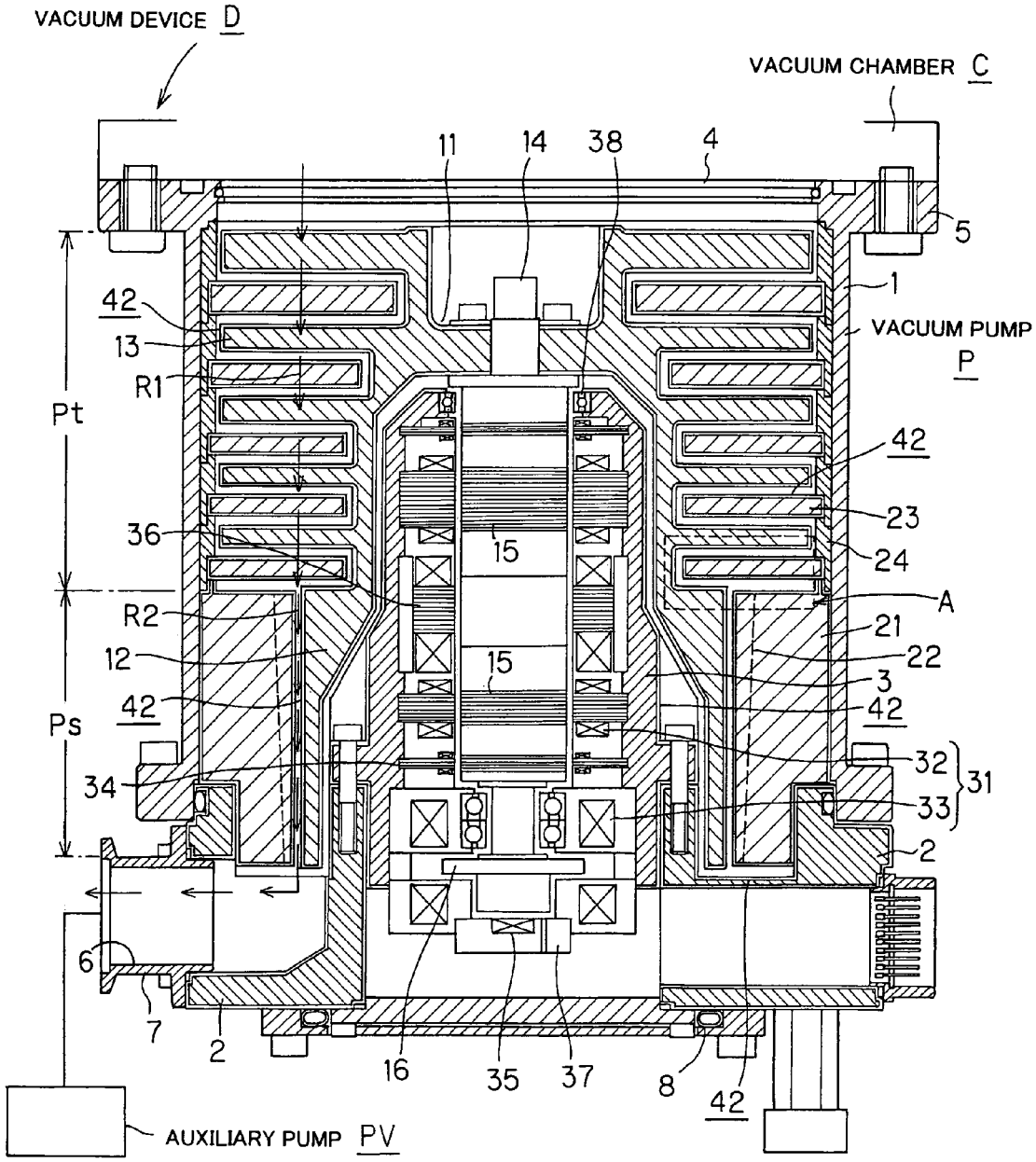
FIG. 1 is a sectional view showing the entire construction of a vacuum pump to which the present invention is applied.

A vacuum pump P shown in FIG. 1 is a kinetic pump used as means for reducing the pressure in a vacuum chamber C in semiconductor manufacturing apparatus, and a composite pump containing a turbo-molecular pump section Pt and a thread groove pump section Ps in a pump case 1 made of stainless steel. On the upper surface of the pump case 1, an intake port 4 serving as an inlet for gas molecules is open, and at the side of a base 2 made of aluminum fixed to the bottom part of the pump case 1, an exhaust port 6 serving as an outlet for gas molecules is open. A peripheral edge flange 5 of the intake port 4 is fastened to a peripheral edge part of an exhaust port of a vacuum chamber C, and an exhaust pipe 7 fitted in the exhaust port 6 is connected to an intake port of a positive displacement auxiliary pump PV, by which a vacuum device D is constituted.

First, the construction of the rotation side of the vacuum pump P will be explained.

In the center of the pump case 1 is contained a rotor 11. The rotor 11 of this embodiment is of a half-blade type provided with rotor blades 13 in a substantially half portion of the outer wall surface of a cup-shaped rotor body 12. In other words, a plurality of rows of blades having a predetermined tilt angle are formed only on the upstream side of the outer wall surface of the rotor body 12 in a radial form, and a plurality of stages of the rotor blades 13, . . . consisting of these blades are formed in the axial direction. On the other hand, the downstream side of the outer wall surface of the rotor body 12 has a smooth cylindrical surface formed with no blade. The rotor 11 having the above-described shape is preferably made of a metallic material, especially a light alloy such as an aluminum alloy or a magnesium alloy, from the viewpoint of high workability and lightweight. In this embodiment, an aluminum alloy is used considering heat conductivity. The rotor 11 is formed of an aluminum alloy and has a surface treatment layer 42 to efficiently release frictional heat and compression heat due to gas molecules while having high corrosion resistance to corrosive gas.

Figure 2:
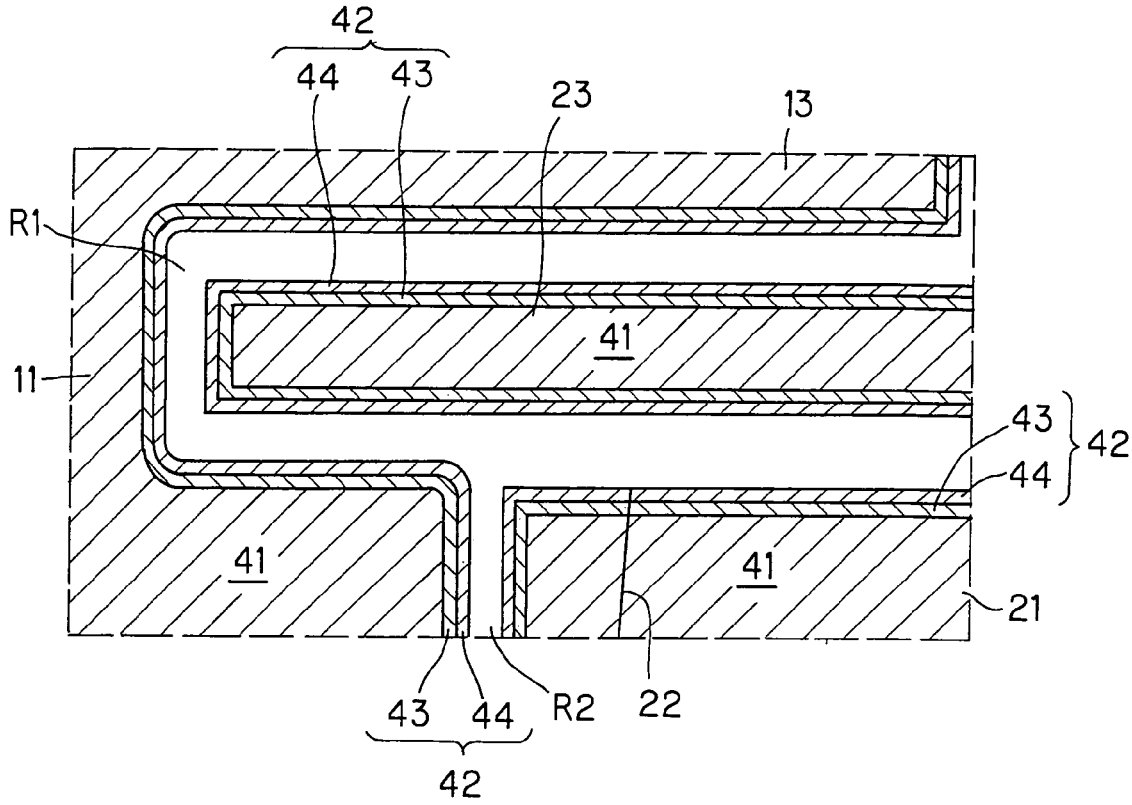
FIG. 2 is an enlarged view of a portion indicated by A in FIG. 1.

As enlargedly shown in FIG. 2, the surface treatment layer 42 has a construction such that a nickel alloy layer 43, which is formed by coating a base material 41 made of an aluminum alloy with nickel having high corrosion resistance and mechanical strength, is provided, and a nickel oxide 44, which is produced by oxidizing nickel, is further formed on the surface of the nickel alloy layer 43. The nickel alloy layer 43 provided on the base material 41 made of an aluminum alloy has a function of inhibiting the intrusion of corrosive gas into the base material to prevent erosion. Also, the reason for forming the nickel oxide 44 on the surface of the nickel alloy layer 43 is that the emissivity is enhanced to increase the quantity of heat radiated from the surface.

In this embodiment, because the rotor 11 has an intricate shape, nonelectrolytic plating in which metal is deposited by utilizing a reducing reaction is performed to form the nickel alloy layer 43 having a uniform thickness on the base material 41. Specifically, after the surface of the base material 41 made of aluminum alloy formed in a predetermined shape has been cleaned, the base material 41 is immersed in a plating solution containing nickel metal ions and a reducing agent. Thereby, the nickel metal ions in the plating solution are reduced by the action of the reducing agent, so that the nickel alloy layer 43 in which nickel metal is deposited is formed on the base material 41 made of an aluminum alloy. The nickel alloy layer 43 of this embodiment consists of a nickel-phosphorus alloy using sodium hypophosphite as the reducing agent.

The thickness of the nickel alloy layer 43 should be at least 10 μm, which is a target value considering tolerance variations. If the thickness is increased, the probability of pinholes arriving at the surface of the base material 41 decreases, and thereby the intrusion of corrosive gas can be inhibited surely, but the mass of rotating body is increased by the increase in thickness. Therefore, the thickness of the nickel alloy layer 43 should preferably be about 20 μm.

Figure 3:
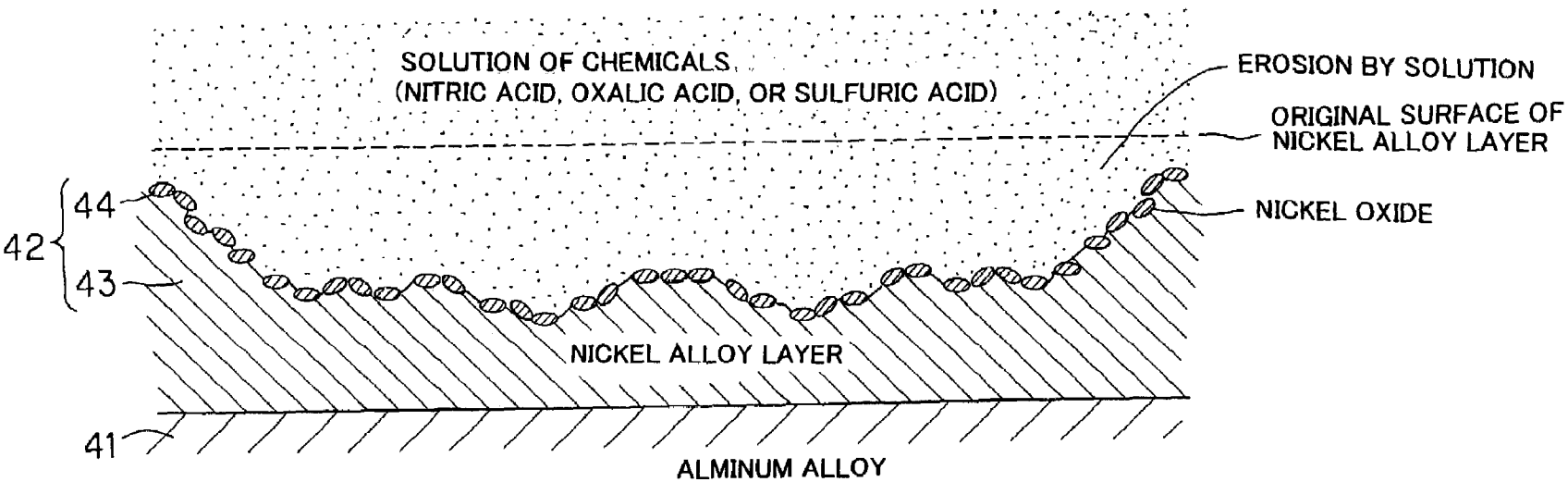
FIG. 3 is a schematic view showing a principle of surface treatment.

Also, on the surface of the nickel alloy layer 43, the nickel oxide 44, which is formed by forcedly oxidizing nickel on the surface by the reaction of an oxidizing agent, is formed. Specifically, a component subjected to surface treatment of the nickel alloy layer 43 by nonelectrolytic plating is immersed in solution of chemicals consisting of an aqueous solution of oxidizing agent such as nitric acid, oxalic acid, or sulfuric acid. Thereby, as shown in FIG. 3, on a boundary surface between the solution and the nickel alloy layer 43, a violent erosion reaction takes place forcedly by means of the action of oxidizing agent in the solution. As a result, oxidation proceeds from the surface layer of nickel crystal forming the nickel alloy layer 43, and then the nickel oxide 44 having a color close to black is formed over the substantially whole surface of the nickel alloy layer 43.

The rotor 11 provided with the aforementioned surface treatment layer 42 is supported by a magnetic levitation type bearing structure. Specifically, a rotor shaft 14 made of stainless steel is integrated on the axis of the rotor 11, and the rotor shaft 14 is supported by a magnetic bearing 31 incorporated in an aluminum alloy made stator column 3 fixed on the base 2. The magnetic bearing 31 includes a radial electromagnet 32 for generating a magnetic attraction force in the radial direction and an axial electromagnet 33 for generating a magnetic attraction force in the axial direction. The former radial electromagnet 32 is opposedly arranged in a pair on the circumference of steel plates 15 with the steel plates 15 having high magnetic permeability laminated on the outer peripheral surface of the rotor shaft 14 being held therebetween. The latter axial electromagnet 33 is opposedly arranged in a pair above and below of an axial disc 16 with the axial disc 16 having high magnetic permeability mounted in the lower end part of the rotor shaft 14 being held therebetween.

Both of the base 2 and the stator column 3 are formed of an aluminum alloy, and, like the rotor 11, is provided with the surface treatment layer 42 consisting of the nickel alloy layer 43 and the nickel oxide 44 which are formed on the base material 41 made of an aluminum alloy.

When the radial electromagnets 32 are excited to attract the steel plates 15, and the axial electromagnets 33 are excited to attract the axial disc 16, the rotor shaft 14 is floatingly supported at a fixed position in the radial and axial directions. Also, the displacements of the rotor shaft 14 in the radial and axial directions are detected by a radial displacement sensor 34 and an axial displacement sensor 35, and the position of the rotor shaft 14 is controlled by the adjustment of the magnetic forces excited in both the electromagnets 32 and 33. The rotor 11 magnetically levitated in this manner is rotated at a high speed by the energization of a rotationally driving motor 36 consisting of a motor stator incorporated in the stator column 3 and a motor rotor mounted on the rotor shaft 14, and the rotational speed thereof is controlled based on the detected value of a rotational speed sensor 37.

Further, this vacuum pump P incorporates a dry bearing 38 for protection in addition to the magnetic bearing 31. This bearing 38 is a rolling bearing having balls between an outer race mounted on the inner wall surface of the stator column 3 and an inner race moving at the inner periphery of the outer race, and a solid lubricant is applied on the balls and both the rolling surfaces of inner and outer races. When the magnetic bearing 31 operates normally, the bearing 38 is not in contact with the rotor shaft 14, and when the magnetically levitated rotor 11 is dropped by a trouble of power source for the magnetic bearing 31, the step portion of the rotor shaft 14 is supported by the inner race, so that the bearing 38 plays a role in preventing damage caused by the contact of the rotor blade 13 with a stator blade 23. Since the non-contact type magnetic bearing 31 and the dry bearing 38 using no oily lubricant are used as the bearings for the rotating body, dust particles produced by metal wear and gas produced by the evaporation of oil under vacuum are not generated, so that the vacuum pump P can be used suitably for the vacuum device D in which a clean environment indispensable to the manufacture of semiconductors is required.

Next, the construction of the fixed side of the vacuum pump P will be explained.

In a lower part in the pump case 1, a threaded spacer 21 is fitted and fixed. The threaded spacer 21 has a thick-wall cylindrical shape that fills a space between the pump case 1 and the rotor 11, and is fixed to the base 2. The inner wall surface of the threaded spacer 21 is formed with a spiral thread groove 22, and faces to the cylindrical surface of the rotor body 12 with a small gap being provided therebetween. The thread groove 22 is formed so as to become shallower gradually from the upstream side to the downstream side, and communicates with the exhaust port 6 at the rear stage. That is to say, the thread groove 22 defines a flow passage R2 for gas molecules in a thread groove pump section Ps. The threaded spacer 21 having the aforementioned shape is also made of an aluminum alloy. Since the threaded spacer 21 faces to the flow passage R2 for gas molecules, it is provided with the surface treatment layer 42 consisting of the nickel alloy layer 43 and the nickel oxide 44 on the base material 41 made of an aluminum alloy.

Also, above the threaded spacer 21, the stator blades 23, . . . , in which a plurality of rows of blades having a tilt angle opposite to the rotor blade 13 are formed radially, are arranged alternately between the rotor blades 13, 13. Above the threaded spacer 21, a plurality of annularly-shaped fixing spacers 24 are laminated, and the stator blade 23 held between the fixing spacers 24, 24 is positioned with a small gap provided between the stator blade 23 and the rotor blade 13. This gap is defined so as to become narrower gradually from the upstream side to the downstream side, and communicates with the thread groove 22 at the rear stage. The gap defines a flow passage R1 for gas molecules in the turbo-molecular pump section Pt. The stator blade 23 is also formed of an aluminum alloy. Since the stator blade 23 faces to the flow passage R1 for gas molecules, it is provided with the surface treatment layer 42 consisting of the nickel alloy layer 43 and the nickel oxide 44 on the base material 41 made of an aluminum alloy.

Next, the operation of the vacuum pump P will be explained with reference to FIG. 1.

First, the positive displacement auxiliary pump is operated to roughly draw the atmospheric air in the vacuum chamber C, and the pressure in the vacuum chamber C is reduced until the pressure becomes in a backing pressure range capable of operating the vacuum pump P. When the power source for the vacuum pump P is turned on to energize the rotationally driven motor 36, in the turbo-molecular pump section Pt at the front stage, the rotor body 12 and a plurality of stages of the rotor blades 13, . . . are synchronously rotated at a high rated rotational speed. Therefore, gas molecules in a free molecule state, which lie near the intake port 4, collide with uppermost-stage rotor blade 13 and are sucked into the pump case 1. The sucked gas molecules are provided with momentum in the transfer direction while colliding with the rotor blade 13 and the stator blade 23 at the intermediate stage alternately, and are gradually compressed into an intermediate flow state while the flow passage R1 is narrowed gradually by the collision with the rotor blade 13 and the stator blade 23 at the compression stage. The gas molecules compressed into the intermediate flow state are transferred to the thread groove pump section Ps at the rear stage.

In the following thread groove pump section Ps, the cylindrical surface of the rotor body 12 rotates at a high speed, and the gas molecules of intermediate flow are guided into a narrow gap between this cylindrical surface and the thread groove 22 in the threaded spacer 21 and are further compressed into a high-pressure viscous flow state while the flow passage R2 is narrowed gradually. The compressed gas molecules of viscous flow pass through the base 2 and are discharged through the exhaust port 6. By such a series of exhaust operation of suction, compression, and exhaust of gas molecules, the pressure in the vacuum chamber C is reduced to a degree of vacuum best suitable for plasma reaction.

In the case where etching or cleaning utilizing the plasma reaction is performed in the vacuum chamber C during the above-described exhaust operation of the vacuum pump P, a chlorine-based or fluorine-based process gas with high reactivity, what is called a corrosive gas, is introduced into the vacuum chamber C, and naturally this corrosive gas is sucked into the pump case 1 of the vacuum pump P. In this case, components facing to the flow passages R1 and R2 through which the corrosive gas passes are provided with the surface treatment layer 42 consisting of the nickel alloy layer 43 with high corrosion resistance and the nickel oxide 44 as described above, so that the base material 41 made of an aluminum alloy can be protected from erosion caused by the corrosive gas. The components that come into contact with the corrosive gas in the pump case 1 are the rotor body 12, the rotor blade 13, and the stator blade 23 in the turbo-molecular pump section Pt at the front stage, and the rotor body 12, the threaded spacer 21, and the thread groove 22 in the thread groove pump section Ps at the rear stage. All of the wall surfaces of these components are provided with the surface treatment layer 42 with high corrosion resistance, so that the corrosive gas is prevented from intruding into the base material.

Also, the nickel oxide 44 is formed only on a very thin surface layer of the nickel alloy layer 43, and is incorporated in a nickel metal crystal forming the nickel alloy layer 43. Therefore, practically as well, the adhesion strength does not become insufficient, and the nickel oxide 44 sufficiently withstands the centrifugal force of the rotor 11 rotating at a high speed during the operation of the vacuum pump P, and does not scatter. In addition, the formed nickel oxide 44 itself does not contain an additive such as sulfur, so that there is no fear of impairing the corrosion resistance to corrosive gas.

On the other hand, for the rotor blade 13, the collision and compression of gas molecules are repeated during the above-described exhaust operation of the vacuum pump P, so that the frictional heat and compression heat are accumulated in the rotor 11, and the rotor 11 may be overheated. In this embodiment, the heat of the rotor 11 is released as described below. First, the rotor 11 rotating at a high speed is floatingly supported by the magnetic bearing 31, and the rotor shaft 14 is not in contact with the electromagnets 32 and 33, so that it cannot be anticipated that the heat of the rotor 11 is directly conducted from the rotor shaft 14 to the stator column 3 incorporating the magnetic bearing 31. Therefore, the heat of the rotor 11 is released by the radiation to the components on the fixed side, and the heat is transmitted on the outer wall surface side and the inner wall surface side of the rotor 11 as described below.

On the outer wall surface side of the rotor 11, heat is transmitted by radiation between the rotor blade 13 and the stator blade 23 facing to each other with the narrowest gap provided therebetween in the turbo-molecular pump section Pt at the front stage, and the heat is transmitted by radiation between the rotor body 12 and the threaded spacer 21 facing to each other with the narrowest gap provided therebetween in the thread groove pump section Ps at the rear stage. On the outermost surface layers of the outer wall surfaces of the rotor blade 13 and the rotor body 12, the nickel oxide 44 with high emissivity is formed as described above, and the quantity of radiated heat is large. Therefore, the heat is transmitted efficiently from the rotor blade 13 and the rotor body 12 to the stator blade 23 and the threaded spacer 21.

On the inner wall surface side of the rotor 11, heat is transmitted by radiation between the rotor body 12 and the stator column 3 and between the rotor body 12 and the base 2. On this side as well, on the outermost surface layer of the inner wall surface of the rotor body 12, the nickel oxide 44 with high emissivity is formed and the quantity of radiated heat is large, so that the heat is transmitted efficiently from the rotor body 12 to the stator column 3 and the base 2. Therefore, in the case where gas molecules with low heat conductivity, such as a rare gas, is exhausted, even if the pump case 1 is not filled with a purge gas with high heat conductivity unlike the conventional example, the heat of the rotor 11 can be released efficiently.

Incidentally, the emissivity of the surface of the nickel oxide 44 is about 0.6 to 0.7, which is higher than, for example, the emissivity of aluminum of 0.3 and the emissivity of non-electrolytic nickel plating of 0.1 to 0.2. Therefore, the quantity of radiated heat can be increased significantly as compared with the conventional rotor made of an aluminum alloy or the rotor subjected to nickel alloy plating on aluminum alloy.

Furthermore, the quantity of heat transmitted by the radiation of the rotor 11 to the components on the fixed side of the base 2, the stator column 3, the threaded spacer 21, and the stator blade 23 is removed as described below. The base 2 is made of an aluminum alloy with high heat conductivity, and a cooling pipe 8 is provided on the bottom surface thereof. The cooling pipe 8 is filled with a coolant so that both of the base 2 and the aluminum alloy made stator column 3 that is in contact with the base 2 are controlled so as to have a low temperature. Thereby, the quantity of heat transmitted by radiation from the inner wall surface of the rotor body 12 is removed.

The threaded spacer 21 and the stator blade 23 are also made of an aluminum alloy with high conductivity. The threaded spacer 21 is directly in contact with the base 2, and the stator blade 23 is in contact with the base 2 via the fixing spacer 24 made of an aluminum alloy. Therefore, the threaded spacer 21 and the stator blade 23 are cooled rapidly by good heat conduction from the base 2 that is controlled so as to have a low temperature. Thereby, the quantity of heat transmitted by radiation from the outer wall surfaces of the rotor body 12 and the rotor blade 13 is also removed smoothly.

As described above, according to the vacuum pump P of this embodiment, of the components incorporated in the pump case 1, especially the rotor 11, which is not only exposed to a corrosive gas but also heated by the frictional heat and compression heat of gas during high-speed rotation, is prevented from being erosion fractured due to corrosive gas or creep fractured due to overheating, so that high-performance evacuation can be accomplished.

Figure 4:
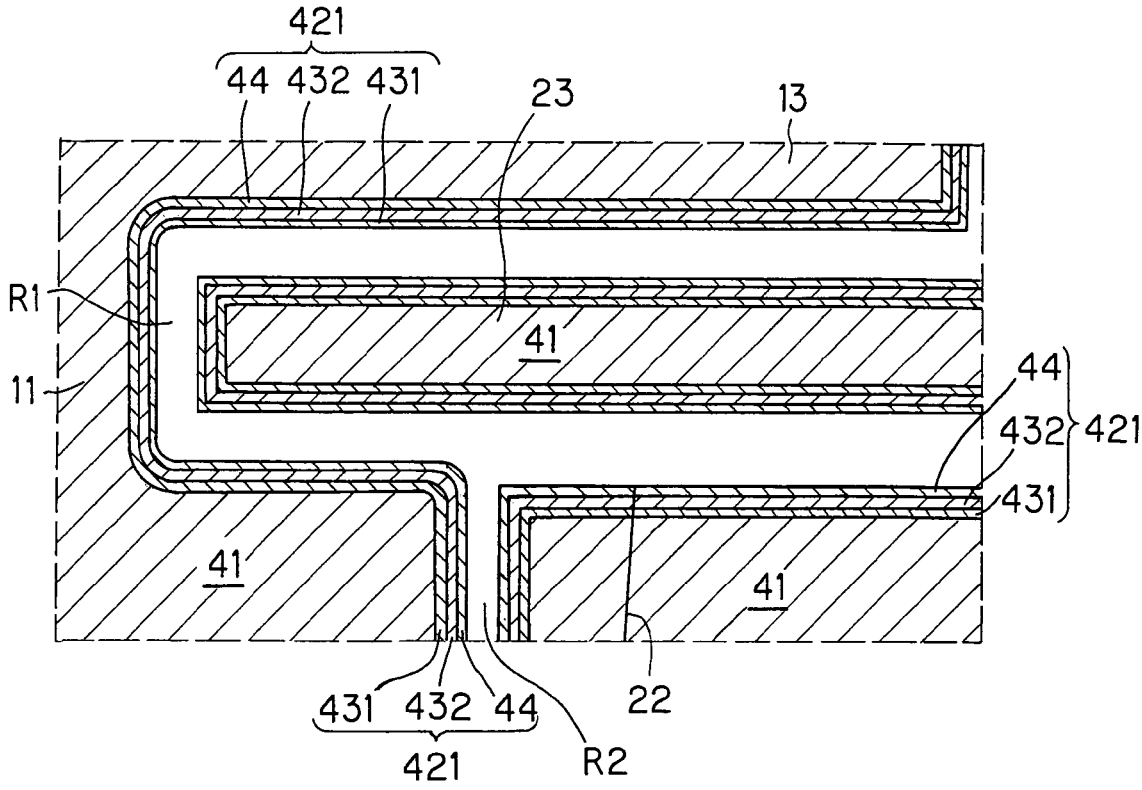
FIG. 4 is an enlarged sectional view showing another construction of a surface treatment layer.

As another mode of the surface treatment layer 42 that is superior in both corrosion resistance and heat releasing property, a construction shown in FIG. 4 can be adopted. The surface treatment layer 421 shown in FIG. 4 is different from the surface treatment layer 42 shown in FIG. 2 in that the nickel alloy layer 43 has a laminated construction. The surface treatment layer 421 is constructed so that a lower nickel alloy layer 431 coated with nickel is provided on the base material 41 made of an aluminum alloy, an upper nickel alloy layer 432 coated similarly with nickel is provided on the lower nickel alloy layer 431, and the nickel oxide 44, which is produced by oxidizing nickel, is further formed on the surface of the upper nickel alloy layer 432.

In order to form the two nickel alloy layers of the lower nickel alloy layer 431 and the upper nickel alloy layer 432, layer formation is performed by dividing the process of the above-described nonelectrolytic nickel plating into two cycles. The laminated construction is not limited to two layers, and three or more layers may be used. Not only two-layer nickel plating or three-layer nickel plating using the same kind of nickel but also alloy plating of nickel and a different kind of metal can be used, and these types of plating can be combined. As examples of an alloy of nickel and a different kind of metal, a nickel-phosphorus alloy and a nickel-boron alloy can be cited.

Figure 5:
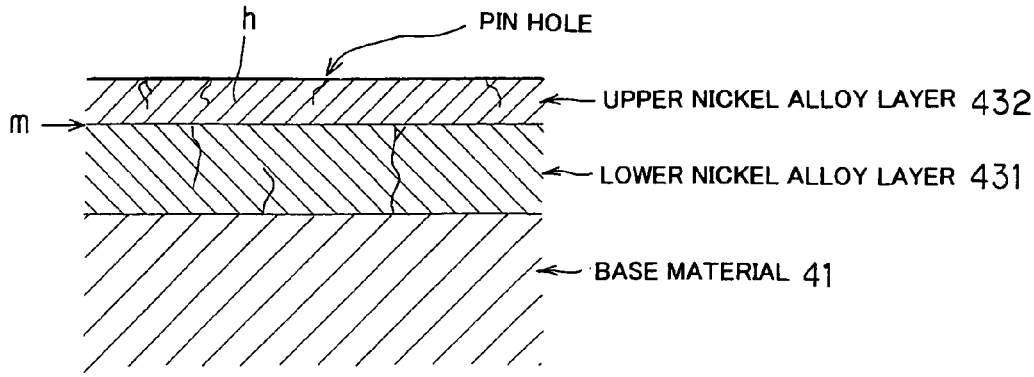
FIG. 5 is a schematic view showing a state of pinholes appearing in a nickel alloy layer.

The reasons why the nickel alloy layer 43 has a laminated construction as described above are two points described below. First, the first point is that the nickel oxide 44 is formed on the surface of the upper nickel alloy layer 432 located in the uppermost layer, and nickel crystals are eroded by the oxidizing agent in this formation process, the thickness of nickel being decreased, so that a decrease in corrosion resistance due to the decrease in thickness is prevented. The second point is that as shown in FIG. 5, pinholes h appearing in the upper nickel alloy layer 432 in the uppermost layer are cut by a boundary surface m between the upper nickel alloy layer 432 and the lower nickel alloy layer 431 under the upper nickel alloy layer 432, by which the probability that the pinholes h penetrate from the surface of the upper nickel alloy layer 432 to the surface of the base material 41 is made as low as possible. By making the nickel alloy layer 43 have the laminated construction as described above, the corrosive gas intruding into the base material 41 made of an aluminum alloy through the pin holes h can be shut off surely. Therefore, in addition to the operation and effects of the above-described embodiment, there is offered an advantage that the surface treatment layer 42 can be provided with far higher corrosion resistance.

Figure 6:
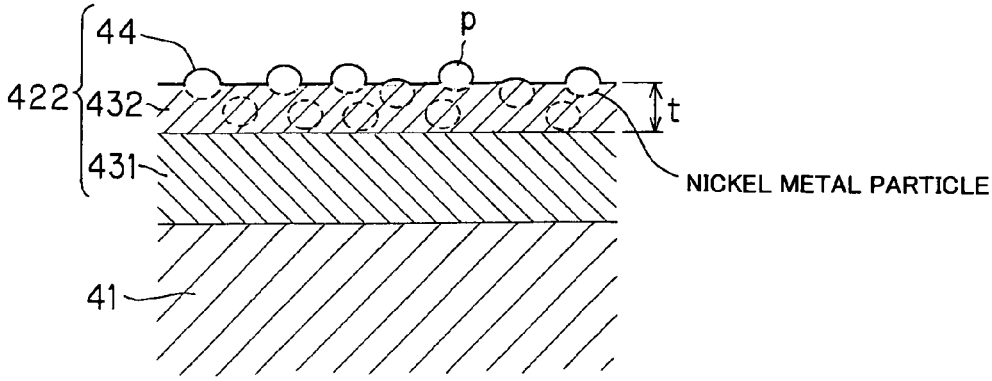
FIG. 6 is a schematic view showing another construction of a surface treatment layer.

Furthermore, as still another mode of the surface treatment layer 42, a construction shown in FIG. 6 can be adopted. The surface treatment layer 422 shown in FIG. 6 is different from the surface treatment layer 421 shown in FIG. 4 in that the surface area of the upper nickel alloy layer 432 is increased. For the surface treatment layer 422, after the lower nickel alloy layer 431 has been plated, plating is performed by mixing nickel metal particles p in a nickel plating solution, by which the nickel metal particles p show on the surface layer, and thus irregularities are formed on the surface of the upper nickel alloy layer 432. The above-described oxidizing treatment is performed on the surface of the upper nickel alloy layer 432 having irregularities, by which the nickel oxide 44 is formed on the increased surface area.

The nickel metal particles p existing in the upper nickel alloy layer 432 are bonded firmly and integrated with the upper nickel alloy layer 432, so that no influence is exerted on the corrosion resistance of that layer. Also, since the oxidizing treatment is performed after the surface area has been increased, the surface area of the formed nickel oxide 44 is also increased. Therefore, by a synergetic effect of improved emissivity and increased surface area, the surface treatment layer 422 ideal for heat radiation of component can be formed.

It is effective that the diameter of the nickel metal particle p is at least not smaller than one half of a thickness t of the upper nickel alloy layer 432, and especially if the diameter thereof is not smaller than the thickness t, the effect can further be increased. Also, in the case where the thickness t of the upper nickel alloy layer 432 is large, after a nickel plating layer with a predetermined thickness has been formed, plating may be performed by mixing particles such as to have a high ratio of the particle diameter to the thickness t.

In the above-described embodiment, the following various modifications can be made. For example, although the base 2, the stator column 3, the threaded spacer 21, and the stator blade 23, which are components on the fixed side, are provided with the surface treatment layer 42 consisting of the nickel alloy layer 43 and the nickel oxide 44 on the base material 41, instead, ceramics coating treatment may be performed on the surfaces of the components as hole sealing treatment, or since the base material 41 is made of an aluminum alloy, only alumite coating treatment may be performed. This is because these components on the fixed side are components that have no thermal load due to rotation and have less danger of erosion than the rotor 11.

As the shape of the rotor 11 provided with the aforementioned surface treatment layer 42, a half-blade type in which the rotor blades 13 are provided substantially on a half of the outer wall surface of the rotor body 12 is used. Besides, an all-blade type in which the rotor blades 13 are provided on the whole surface of the outer wall surface of the rotor body 12 or a no-blade type in which the rotor blades 13 are not provided may be used. Also, the type of the vacuum pump P is not limited to a composite pump. The invention can be applied in the same way to the components incorporated in a single turbo-molecular pump, a single thread groove pump, a peripheral pump, and other types of pumps.

What is claimed is:

1. A vacuum pump comprising:

a pump case;

a pump section that is disposed in the pump case and that performs an evacuating operation by which gas molecules in a vacuum chamber are sucked into and exhausted from the pump case, the pump section having at least one component that is heated during operation of the vacuum pump and that defines a flow path through which the gas molecules flow prior to being exhausted from the pump case;

at least one nickel alloy layer disposed on a surface of the component of the pump section for increasing a resistance of the component to corrosion due to a corrosive effect of the gas molecules flowing through the flow path; and a nickel oxide formed on a surface of the nickel alloy layer for increasing a quantity of heat radiated from the surface of the component when the component is heated during operation of the vacuum pump;

wherein the at least one nickel alloy layer comprises a laminated structure of a first nickel alloy layer disposed on a surface of the component and a second nickel alloy layer disposed on a surface of the first nickel alloy layer; wherein the nickel oxide is formed on a surface of the second nickel alloy layer; and wherein the nickel oxide is formed by forced oxidation of the surface of the nickel alloy layer via reaction of an oxidizing agent on the surface of the nickel alloy layer.

2. A vacuum pump comprising:

a pump case;

a pump section that is disposed in the pump case and that performs an evacuating operation by which gas molecules in a vacuum chamber are sucked into and exhausted from the pump case, the pump section having at least one component that is heated during operation of the vacuum pump and that defines a flow oath through which the gas molecules flow prior to being exhausted from the pump case;

at least one nickel alloy layer disposed on a surface of the component of the pump section for increasing a resistance of the component to corrosion due to a corrosive effect of the gas molecules flowing through the flow path; and a nickel oxide formed on a surface of the nickel alloy layer for increasing a quantity of heat radiated from the surface of the component when the component is heated during operation of the vacuum pump;

wherein the at least one nickel alloy layer comprises a laminated structure of a first nickel alloy layer disposed on a surface of the component and a second nickel alloy layer disposed on a surface of the first nickel alloy layer; wherein the nickel oxide is formed on a surface of the second nickel alloy layer; and wherein the nickel oxide comprises a mixture of nickel metal particles and a nickel plating solution non-electrolytically plated on the surface of the nickel alloy layer so that the nickel oxide is formed with irregularities on the surface of the nickel alloy layer.

3. A vacuum pump comprising:

a pump case;

a pump section that is disposed in the pump case and that performs an evacuating operation by which gas molecules in a vacuum chamber are sucked into and exhausted from the pump case, the pump section having at least one component that is heated during operation of the vacuum pump and that defines a flow path through which the gas molecules flow prior to being exhausted from the pump case;

at least one nickel alloy layer disposed on a surface of the component of the pump section for increasing a resistance of the component to corrosion due to a corrosive effect of the gas molecules flowing through the flow path; and a nickel oxide formed on a surface of the nickel alloy layer for increasing a quantity of heat radiated from the surface of the component when the component is heated during operation of the vacuum pump;

wherein the at least one nickel alloy layer comprises a laminated structure of a first nickel alloy layer disposed on a surface of the component and a second nickel alloy layer disposed on a surface of the first nickel alloy layer; and wherein the oxide is formed on a surface of the second nickel alloy layer.

4. A vacuum pump according to claim 3; wherein the nickel oxide has a higher emissivity than that of the nickel alloy layer.

5. A vacuum pump according to claim 4; wherein the emissivity of the nickel oxide is at least 0.6.

6. A vacuum pump according to claim 3; wherein the nickel oxide is formed by forced oxidation of the surface of the nickel alloy layer via reaction of an oxidizing agent on the surface of the nickel alloy layer.

7. A vacuum pump according to claim 3; wherein the nickel oxide comprises a mixture of nickel metal particles and a nickel plating solution non-electrolytically plated on the surface of the nickel alloy layer so that the nickel oxide is formed with irregularities on the surface of the nickel alloy layer.

8. A vacuum pump according to claim 3; wherein the pump section comprises a rotor mounted in the pump case for undergoing rotation so that the corrosive gas molecules are sucked into and exhausted by the rotational motion of the rotor, a plurality of stages of rotor blades provided on an outer wall surface of the rotor, and a plurality of stages of stator blades provided so as to be positioned and fixed alternately between the rotor blades.

9. A vacuum pump according to claim 3; wherein the pump section comprises a magnetic levitation-type bearing structure and a rotor rotatably supported by the magnetic levitation-type bearing structure for undergoing rotation so that the corrosive gas molecules are sucked into and exhausted by the rotational motion of the rotor.

* * * * *